US007193593B2

(12) United States Patent
Koyama et al.

(10) Patent No.: US 7,193,593 B2
(45) Date of Patent: Mar. 20, 2007

(54) LIQUID CRYSTAL DISPLAY DEVICE AND METHOD OF DRIVING A LIQUID CRYSTAL DISPLAY DEVICE

(75) Inventors: Jun Koyama, Kanagawa (JP); Hajime Kimura, Kanagawa (JP); Yutaka Shionoiri, Kanagawa (JP); Yasuhiro Hirayama, Osaka (JP); Buyeol Lee, Nara (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 419 days.

(21) Appl. No.: 10/651,231

(22) Filed: Aug. 29, 2003

(65) Prior Publication Data

US 2004/0041765 A1 Mar. 4, 2004

(30) Foreign Application Priority Data

Sep. 2, 2002 (JP) ..... 2002-257209

(51) Int. Cl.
*G09G 3/36* (2006.01)

(52) U.S. Cl. ..... 345/87; 345/98; 345/99

(58) Field of Classification Search ..... 345/87–100, 345/204–213, 680–699
See application file for complete search history.

(56) References Cited

U.S. PATENT DOCUMENTS 6,049,321 A * 4/2000 Sasaki ..... 345/99
6,424,328 B1 * 7/2002 Ino et al. ..... 345/87
6,486,497 B2 11/2002 Misawa et al.
6,784,865 B2 * 8/2004 Akimoto et al. ..... 345/98
6,909,411 B1 6/2005 Yamazaki
2001/0045932 A1 11/2001 Mukao
2002/0063674 A1 5/2002 Chiang
2002/0089485 A1 7/2002 Youn
2003/0006979 A1 * 1/2003 Tsuchi et al. ..... 345/204
2003/0085865 A1 5/2003 Lee
2004/0041764 A1 3/2004 Koyama

FOREIGN PATENT DOCUMENTS

JP 62-143095 6/1987
JP 01-289917 11/1989

OTHER PUBLICATIONS

Jun Koyama et al.; "Liquid Crystal Display Device and Method of Driving a Liquid Crystal Display Device"; Country Equivalent Application filed Aug. 29, 2003; pp. 1-34 and 17 sheets of drawings—This application claims priority to Japan 2002-257210, filed Sep. 2, 2002.

* cited by examiner

*Primary Examiner*—Sumati Lefkowitz
*Assistant Examiner*—Tammy Pham
(74) *Attorney, Agent, or Firm*—Fish & Richardson P.C.

(57) ABSTRACT

A liquid crystal display device having analog buffer circuits is provided which is reduced in luminance fluctuation. A source signal line driving circuit has a plurality of analog buffer circuits. Source signal lines connected to the analog buffer circuits are switched their connections to different analog buffer circuits each time a new period is started. Output fluctuation among the analog buffer circuits is thus averaged and a uniform image can be displayed on the screen.

36 Claims, 17 Drawing Sheets

LIQUID CRYSTAL DISPLAY DEVICE AND METHOD OF DRIVING A LIQUID CRYSTAL DISPLAY DEVICE

BACKGROUND OF THE INVENTION

1. Field of the Invention

The present invention relates to a liquid crystal display device, and more particularly to a liquid crystal display device using thin film transistors (TFTs) formed on a transparent substrate made of glass, plastic, or the like and a driving method thereof. In addition, the present invention relates to electronic equipment using the liquid crystal display device.

2. Description of the Related Art

In recent years, mobile telephones have become widespread due to development of communication technology. In future, moving picture transmission and a larger amount of information transfer are further expected. With respect to a personal computer, products for mobile applications are manufactured due to a reduction in weight thereof. A large number of information terminals called PDAs started with electronic notebooks are also manufactured and becoming widespread. In addition, with the development of display devices and the like, most of portable information devices are equipped with a flat panel display.

According to recent techniques, an active matrix display device tends to be used as a display device used therefor. In the active matrix display device, a TFT is arranged in each pixel and a screen is controlled by the TFTs. Compared to a passive matrix display device, such an active matrix display device has advantages in that it achieves high performance and high image quality and can handle moving pictures. Thus, it is considered that mainstream liquid crystal display devices will also change from passive matrix types to active matrix types.

Also, of active matrix display devices, in recent years, commercialization of a display device using low temperature polysilicon is progressing. With low temperature polysilicon, not only the pixels but also the driver circuit can be integrally formed on the periphery of the pixel portion, and as miniaturization and high definition of the display device is possible, it is expected that the display device using low temperature polysilicon will become even more widespread.

A description is given below on the operation of a pixel portion in an active matrix liquid crystal display device. FIG. 3 shows an example of the structure of an active matrix liquid crystal display device. One pixel 302 is composed of a source signal line S1, a gate signal line G1, a capacitance line C1, a pixel TFT 303, and storage capacitor 304. The capacitance line is not always necessary if other wire can double as the capacitance line. A gate electrode of the pixel TFT 303 is connected to the gate signal line G1. One of a drain region and a source region of the pixel TFT 303 is connected to the source signal line S1 whereas the other is connected to the storage capacitor 304 and a pixel electrode 305.

Gate signal lines are selected sequentially in accordance with line cycle. If the pixel TFT is an n-channel TFT, setting the gate signal line Hi renders the line active and turns the pixel TFT ON. As the pixel TFT is turned ON, the electric potential of the source signal line is written in the storage capacitor and in a liquid crystal. In the next line period, the adjacent gate signal line becomes active and the electric potential of the source signal line is written in the storage capacitor and the liquid crystal in a similar fashion.

Described next is the operation of a source line driving circuit. FIG. 2 shows an example of a conventional source signal line driving circuit. The source signal line driving circuit in FIG. 2 is for analog type dot sequential driving. In this example, the source signal line driving circuit is composed of a shift register 201, a NAND circuit 207, a buffer circuit 208, and an analog switch 209. First, a source start pulse SSP is inputted to the first stage of the shift register through a switch 206. The switch 206 determines the scanning direction of the shift register. Scanning is made from left to right in FIG. 2 when SL/R is Lo and from right to left when SL/R is Hi. A DFF 202 constitutes each stage of the shift register. The DFF 202 is composed of clocked inverters 203 and 204 and an inverter 205, and shifts pulses each time clock pulses CL and CLb are inputted.

Output of the shift register is inputted to the buffer circuit 208 through the NAND circuit 207. Output of the buffer circuit turns the analog switches 209 to 212 ON for sampling of video signals directed to source signal lines S1 to S4.

A middle- or small-sized liquid crystal panel can be operated by the dot sequential driving described above. However, in a large-sized liquid crystal panel, dot sequential driving cannot provide sufficient time for writing of source signal lines because the wire capacitance of the source signal lines is about 100 pF and delay time of the source signal lines themselves is too great. Then, it becomes impossible to perform writing. Therefore, a large-sized panel needs linear sequential driving in which data is temporarily stored in a memory within the source signal line driving circuit and then written in a source signal line during the next one line period.

Such linear sequential driving needs analog buffer circuits placed downstream of the memory. An example of a source signal line driving circuit adaptable to linear sequential driving is shown in FIG. 4. Analog switches 401 to 404 operate in the same way as the analog switches do in the dot sequential source signal line driving circuit shown in FIG. 2. Unlike FIG. 2 where the analog switches drive source signal lines, the analog switches 401 to 404 drive capacitors 405 to 408, which serve as analog memories. As one line of data are sequentially stored in the analog memories, TRN and TRNb signals become active in the next retrace period to turn analog switches 409 to 412 ON. This starts transfer of the data in the analog memories 405 to 408 to analog memory capacitors 413 to 416.

Then, the analog switches 409 to 412 are turned OFF before the analog switches 401 to 404 are turned ON in preparation for the next sampling. The data in the analog memories 413 to 416 are outputted to source signal lines S1 to S4 through the analog buffer circuits 417 to 420. The data in the analog memories 413 to 416 are kept for one line period and therefore analog buffer circuits 417 to 420 are allowed to take one line period to charge the source lines. In this way, linear sequential driving in a large-sized panel is made possible by analog memories and analog buffer circuits.

However, when analog buffer circuits in a large-sized panel are constituted of TFTs, fluctuation among the analog buffer circuits is a problem. Fluctuation among the analog buffer circuits causes output fluctuation even though video signals of the same gray scale are inputted. As a result, vertical streaks appear on the screen lowering the image quality considerably.

When low temperature polycrystalline silicon is used to manufacture a liquid crystal display device, a driver circuit is integrally formed. However, transistors of this driver circuit are more fluctuated than those in a driver circuit that is formed of single crystal silicon. This is supposedly due to uneven crystallization and damage by electrostatic during the process. When a driving circuit is formed taking into consideration such fluctuation, the fluctuation is more obvious in a component that conducts analog operation, in particular, analog buffer circuits, than in the logic portion.

In the conventional source signal line driving circuit shown in FIG. 4, a voltage difference between the output voltage of each analog buffer circuit and the average of output of plural analog buffer circuits is obtained. A voltage difference between the mean output value and an analog buffer circuit output A is given as ΔVA. Similarly, voltage differences between the mean output value and analog buffer circuit outputs B, C, and D are given as ΔVB, ΔVC, and ΔVD, respectively. When ΔVA is +100 mV, ΔVB is −100 mV, ΔVC is −50 mV, and ΔVD is +30 mV, the difference between the source signal lines S2 and S3 is 50 mV whereas the difference between the source signal lines S1 and S2 is 200 mV, which is large enough for human eyes to recognize the gray scale difference.

SUMMARY OF THE INVENTION

The present invention has been made to solve the above problems, and an object of the present invention is therefore to provide a liquid crystal display device which is reduced in luminance fluctuation by interposing switches between analog buffer circuits and source signal lines to switch outputs. This averages output fluctuation among the analog buffer circuits time-wise, and display unevenness is thus made inconspicuous.

The structure of the present invention is shown below.

According to the present invention, there is provided a liquid crystal display device having on an insulating substrate a plurality of source signal lines, a plurality of gate signal lines, a plurality of pixels, and a source signal line driving circuit for driving the source signal lines, characterized in that the source signal line driving circuit has a plurality of analog buffer circuits, and the source signal lines connected to the analog buffer circuits are periodically switched by the switching circuits their connections to different analog buffer circuits.

According to the present invention, there is provided a liquid crystal display device having on an insulating substrate a plurality of source signal lines, a plurality of gate signal lines, a plurality of pixels, and a source signal line driving circuit for driving the source signal lines, characterized in that the source signal line driving circuit has a plurality of analog buffer circuits, and the source signal lines are switched by the switching circuits their connections to different analog buffer circuits in a random timing.

According to the present invention, there is provided a liquid crystal display device having on an insulating substrate a plurality of pixels, a plurality of source signal lines, a plurality of gate signal lines, and a source signal line driving circuit, the source signal line driving circuit having analog buffer circuits to drive the source signal lines, characterized in that a set of n (n is a natural number that satisfies $2 \leqq n$) periods is repeated periodically, and in an r-th period (r is a natural number that satisfies $1 \leqq r \leqq n$), an m-th source signal line (m is a natural number that satisfies $1 \leqq m$) is connected to an (m+r−1)-th analog buffer circuit.

According to the present invention, there is provided a liquid crystal display device having on an insulating substrate a plurality of pixels, a plurality of source signal lines, a plurality of gate signal lines, and a source signal line driving circuit, the source signal line driving circuit having analog buffer circuits to drive the source signal lines, characterized in that a set of n (n is a natural number that satisfies $2 \leqq n$) periods is repeated in a random timing, and wherein, in an r-th period (r is a natural number that satisfies $1 \leqq r \leqq n$), an m-th source signal line (m is a natural number that satisfies $1 \leqq m$) is connected to an (m+r−1)-th analog buffer circuit.

In the above-mentioned structure of the present invention, it is characterized in that the analog buffer circuits are source follower circuits or voltage follower circuits.

According to the present invention, there is provided a method of driving a liquid crystal display device having on an insulating substrate a plurality of source signal lines, a plurality of gate signal lines, a plurality of pixels, and a source signal line driving circuit for driving the source signal lines, characterized in that the source signal line driving circuit has a plurality of analog buffer circuits, and the source signal lines are periodically driven by different analog buffer circuits.

According to the present invention, there is provided a method of driving a liquid crystal display device having on an insulating substrate a plurality of source signal lines, a plurality of gate signal lines, a plurality of pixels, and a source signal line driving circuit for driving the source signal lines, characterized in that the source signal line driving circuit has a plurality of analog buffer circuits, and the source signal lines are driven by different analog buffer circuits in a random timing.

According to the present invention, there is provided a method of driving a liquid crystal display device having on an insulating substrate a plurality of pixels, a plurality of source signal lines, a plurality of gate signal lines, and a source signal line driving circuit, the source signal line driving circuit having analog buffer circuits to drive the source signal lines, characterized in that a set of n (n is a natural number that satisfies $2 \leqq n$) periods is repeated periodically, and in an r-th period (r is a natural number that satisfies $1 \leqq r \leqq n$), an m-th source signal line (m is a natural number that satisfies $1 \leqq m$) is driven by an (m+r−1)-th analog buffer circuit.

According to the present invention, there is provided a method of driving a liquid crystal display device having on an insulating substrate a plurality of pixels, a plurality of source signal lines, a plurality of gate signal lines, and a source signal line driving circuit, the source signal line driving circuit having analog buffer circuits to drive the source signal lines, characterized in that a set of n (n is a natural number that satisfies $2 \leqq n$) periods is repeated in a random timing, and in an r-th period (r is a natural number that satisfies $1 \leqq r \leqq n$), an m-th source signal line (m is a natural number that satisfies $1 \leqq m$) is driven by an (m+r−1)-th analog buffer circuit.

In the above-mentioned method of driving a liquid crystal display device of the present invention, it is characterized in that the analog buffer circuits are source follower circuits or voltage follower circuits.

Through the above structure and method, vertical streaks are prevented from being displayed on the screen even when analog buffer circuits built on an insulating substrate are fluctuated in output.

DETAILED DESCRIPTION OF THE PREFERRED EMBODIMENTS

Embodiment Mode

An embodiment mode of the present invention will be described in detail below with reference to the drawings.

Figure 1:
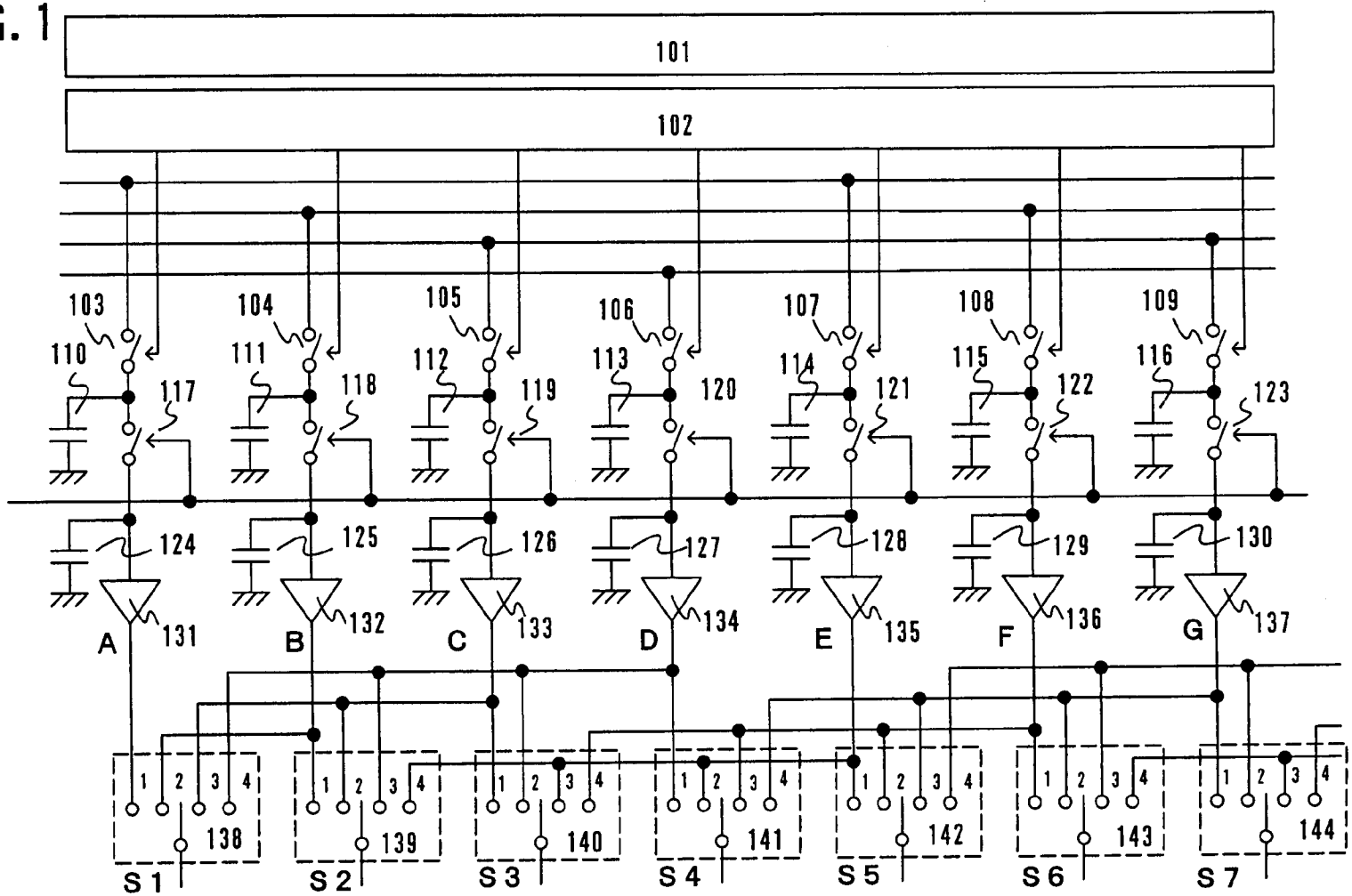
FIG. 1 is a block diagram of a source signal line driving circuit in a liquid crystal display device of the present invention.
Figure 2:
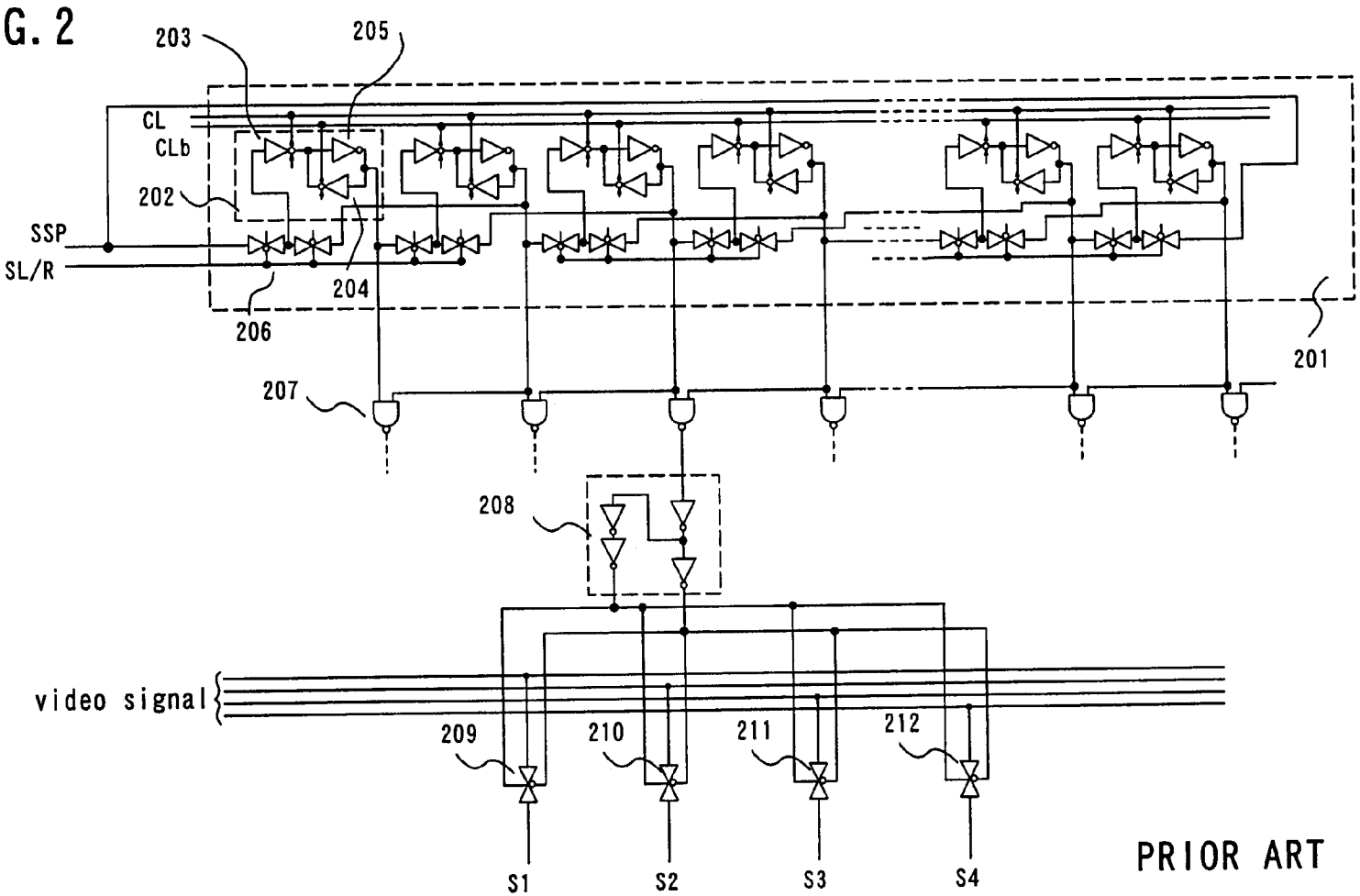
FIG. 2 is a block diagram of a source signal line driving circuit in a conventional liquid crystal display device.
Figure 3:
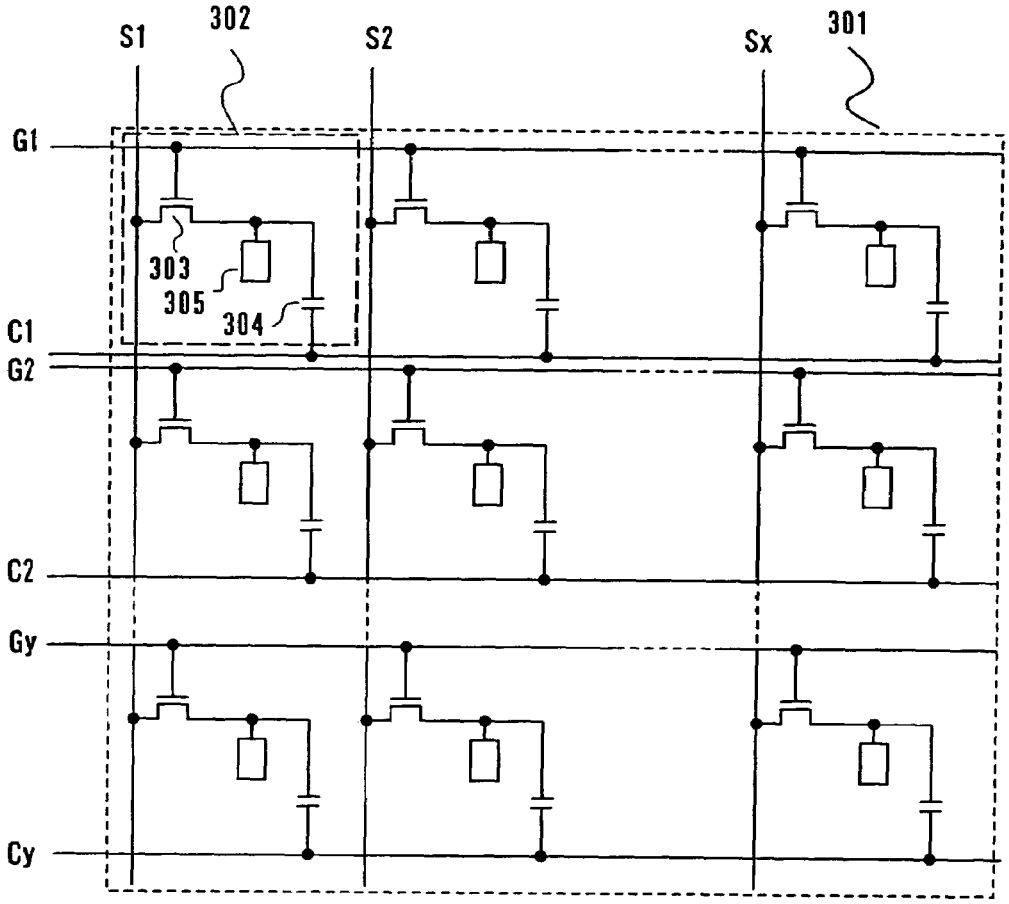
FIG. 3 is a diagram showing a structure of a pixel portion in the liquid crystal display device.
Figure 4:
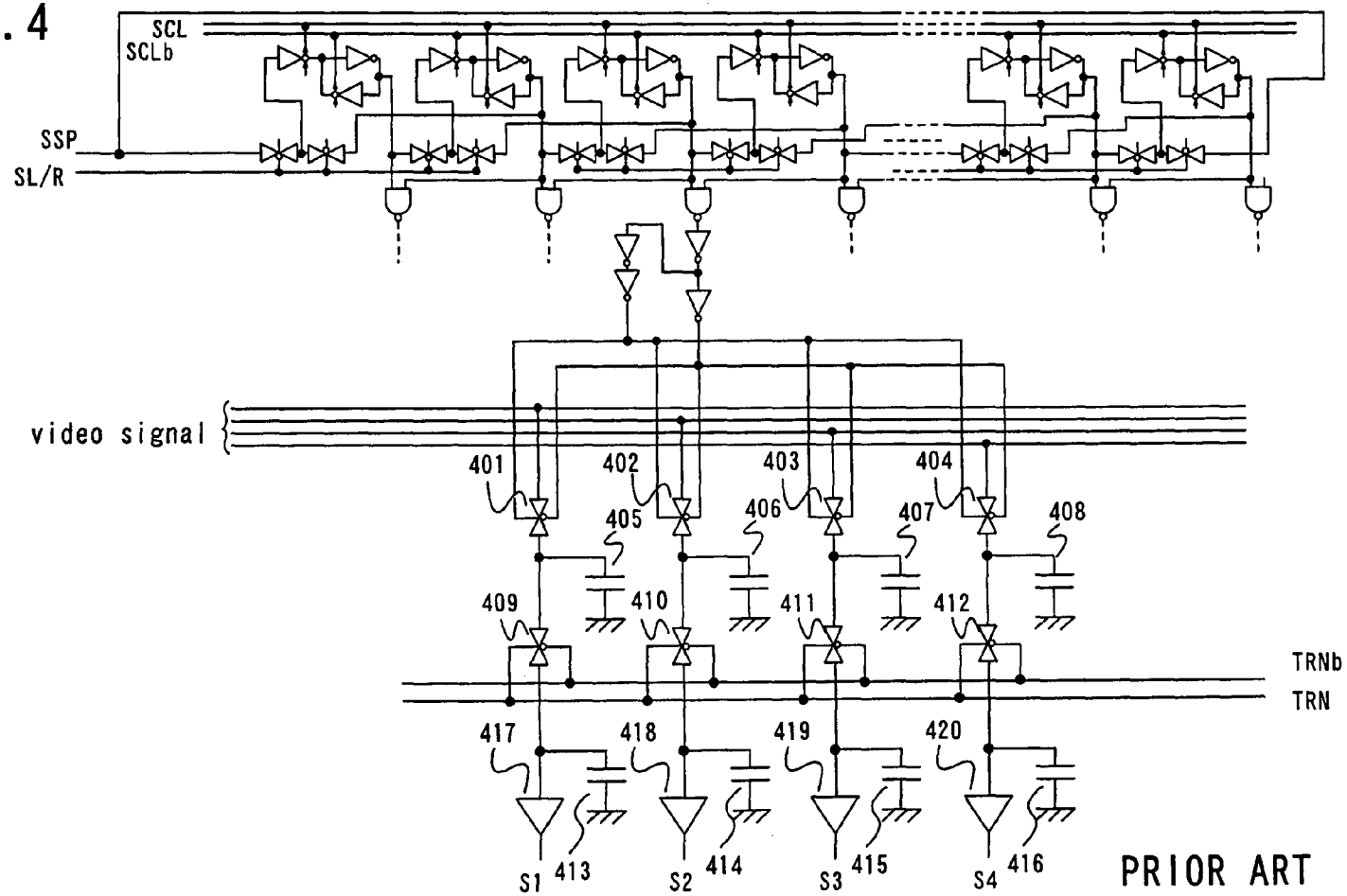
FIG. 4 is a block diagram of the source signal line driving circuit in the conventional liquid crystal display device.

FIG. 1 shows a liquid crystal display device of the present invention. Its shift register and other components are similar to those explained in the prior art. The difference between the present invention and prior art is that the device of FIG. 1 has switches 138 to 144 between analog buffer circuits 131 to 137 and source signal lines S1 to S7. Now, the operation of the device of this embodiment mode is described. This description takes as an example a case of using four-contact point switches for the switches 138 to 144. However, the present invention is not limited to four-contact point switches and the number of contact points does not matter in carrying out the present invention.

In the present invention, connections of the switches 138 to 144 are switched from one to another. Here, the switching cycle is one frame but the present invention is not limited thereto. How the switching is made is described below. In the first frame, the switches 138 to 144 are in a "1" connection state where an output A of the analog buffer circuit 131 is connected to a source signal line S1 whereas outputs B, C, D, E, F; and G of the analog buffer circuits 132 to 137 are connected to source signal lines S2, S3, S4, S5, S6, and S7, respectively.

Next, in the second frame, the switches 138 to 144 are in a "2" connection state where an output B of the analog buffer circuit 132 is connected to a source signal line S1 whereas outputs C, D, E, F; and G of the analog buffer circuits 133 to 137 are connected to source signal lines S2, S3, S4, S5 and S6 respectively. In the third frame, the switches 138 to 144 are in a "3" connection state where an output C of the analog buffer circuit 133 is connected to a source signal line S1 whereas outputs D, E, F, and G of the analog buffer circuits 134 to 137 are connected to source signal lines S2, S3, S4 and S5 respectively.

Next, in the fourth frame, the switches 138 to 144 are in a "4" connection state where an output D of the analog buffer circuit 134 is connected to a source signal line S1 whereas outputs E, F, and G of the analog buffer circuits 135 to 137 are connected to source signal lines S2, S3 and S4 respectively.

Next, in the fifth frame, the switches 138 to 144 are again in a "1" connection state where an output A of the analog buffer circuit 131 is connected to a source signal line S1 whereas outputs B, C, D, E, F, and G of the analog buffer circuits 132 to 137 are connected to source signal lines S2, S3, S4, S5, S6, and S7 respectively. In this way, the switches 138 to 144 repeat a connection change at a period of four frames.

Figure 10:
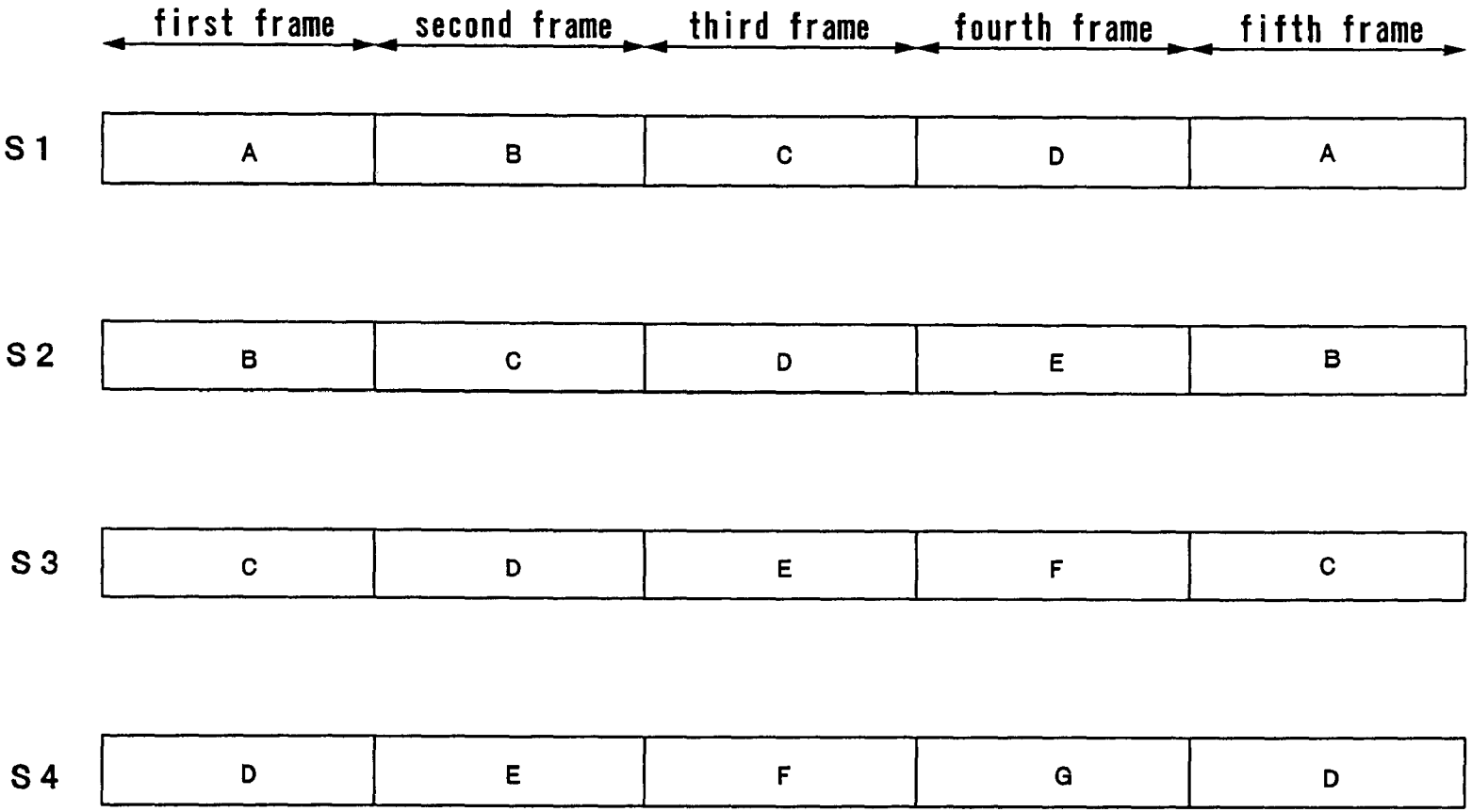
FIG. 10 is a diagram showing output of analog buffer circuits each connected to a source signal line.

The switching is made in a four-frame cycle since four-contact point switches are employed. The cycle can be changed by changing the number of contact points as described above. It is also unnecessary to stick to a frame-based cycle. Any cycle will do as long as the fluctuation can be averaged visually. FIG. 10 shows output of the analog buffer circuits each connected to a source signal line.

As in the prior art, a voltage difference between the output voltage of each analog buffer circuit and the average of output of plural analog buffer circuits is obtained. A voltage difference between the mean output value and the analog buffer circuit output A is given as ΔVA. Similarly, voltage differences between the mean output value and the analog buffer circuit outputs B, C, and D are given as ΔVB, ΔVC, and ΔVD, respectively. Then, the voltage differences seem averaged to human eyes. Accordingly, each of the source signal lines S1, S2, S3, and S4 is given an output electric potential of (ΔVA+ΔVB+ΔVC+ΔVD)/4 and the difference among them is zero.

When ΔVA is +100 mV, ΔVB is −100 mV, ΔVC is −50 mV, and ΔVD is +30 mV as in the prior art, the voltages of the source signal lines S1 to S4 are averaged and each are set to −5 mV. Therefore, the problem of the prior art, in which there is as large an electric potential difference as 200 mV between adjacent lines to make vertical streaks conspicuous, can be avoided.

In the above embodiment mode, the switches each have four contact points and a repeating cycle is composed of four periods. However, the number of periods is not limited to four. The objective effect can be obtained by setting n (n is a natural number equal to or larger than 2) periods and connecting an m-th source signal line (m is a natural number that satisfies $1 \leqq m$) to an (m+r−1)-th analog buffer (r is a natural number that satisfies $1 \leqq r \leqq n$) in an r-th period. Also, the objective effect can be obtained by driving the m-th source signal line with the (m+r−1)-th analog buffer.

Embodiment 1

Figure 7:
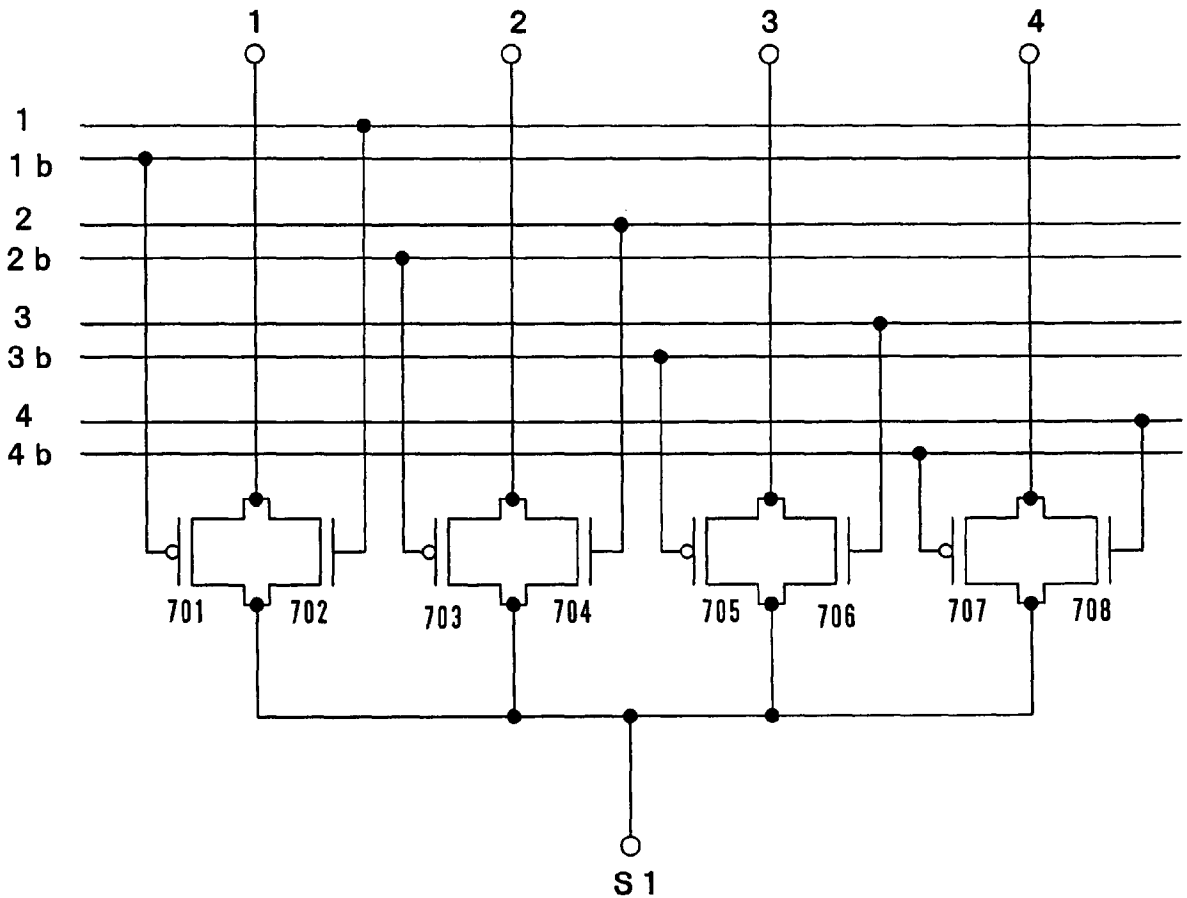
FIG. 7 is a circuit diagram of a switch of the present invention.
Figure 8:
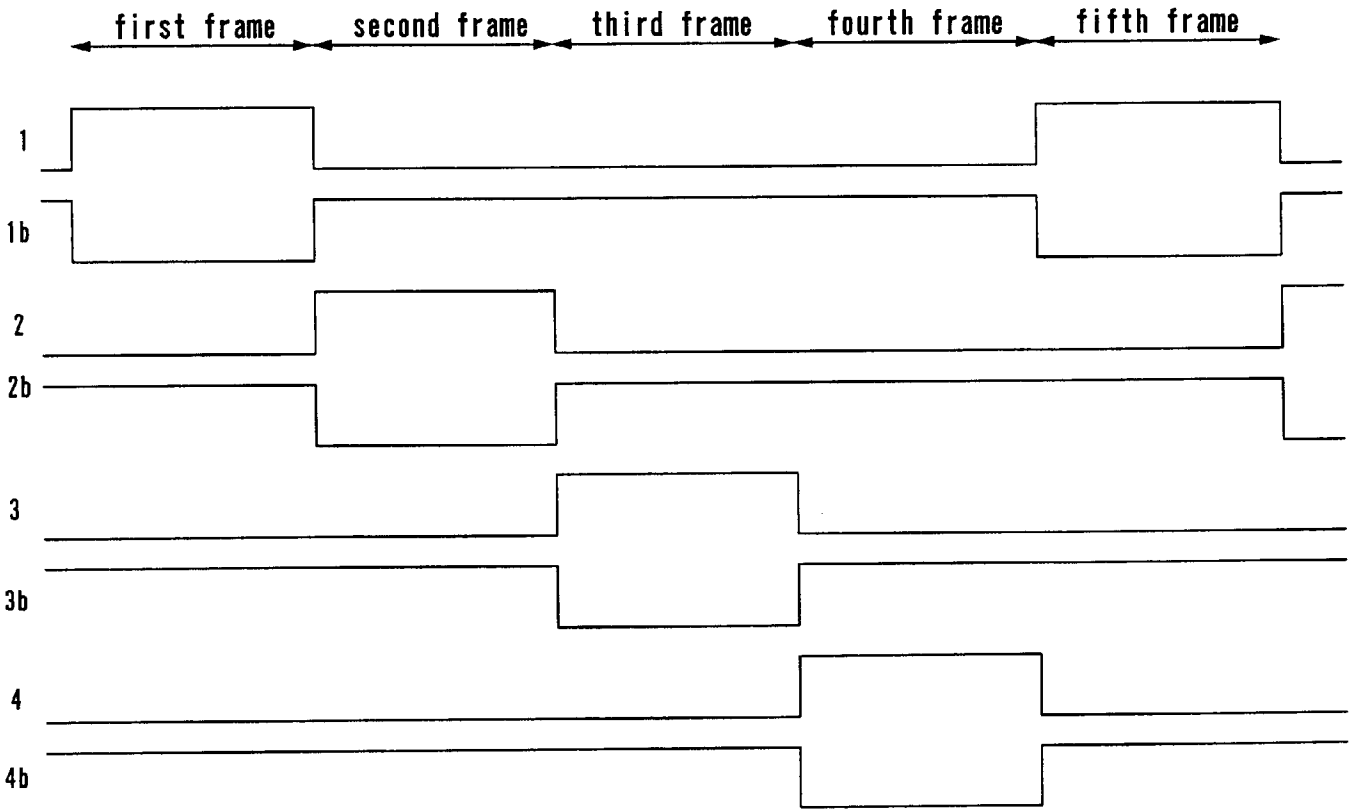
FIG. 8 is a timing chart of the switch of the present invention.

FIG. 7 shows Embodiment 1, which is a specific circuit example of the switch 123 shown in FIG. 1. In this embodiment, an analog switching circuit is used as the switch. The switch is composed of TFTs 701 to 708 and is controlled by control lines 1, 1*b*, 2, 2*b*, . . . , and 4*b*, which are separately connected to gate terminals of the TFTs 701 to 708. FIG. 8 is a timing chart of the control lines 1 to 4*b*. Control signal shown in FIG. 8 connect D in FIG. 1 to source signal lines S1 to S4 during the first to fourth frame. The circuit diagram shown in FIG. 7 has a CMOS structure but may have an NMOS structure or a PMOS structure instead. In this case, the number of control lines is cut in half.

Embodiment 2

Figure 5:
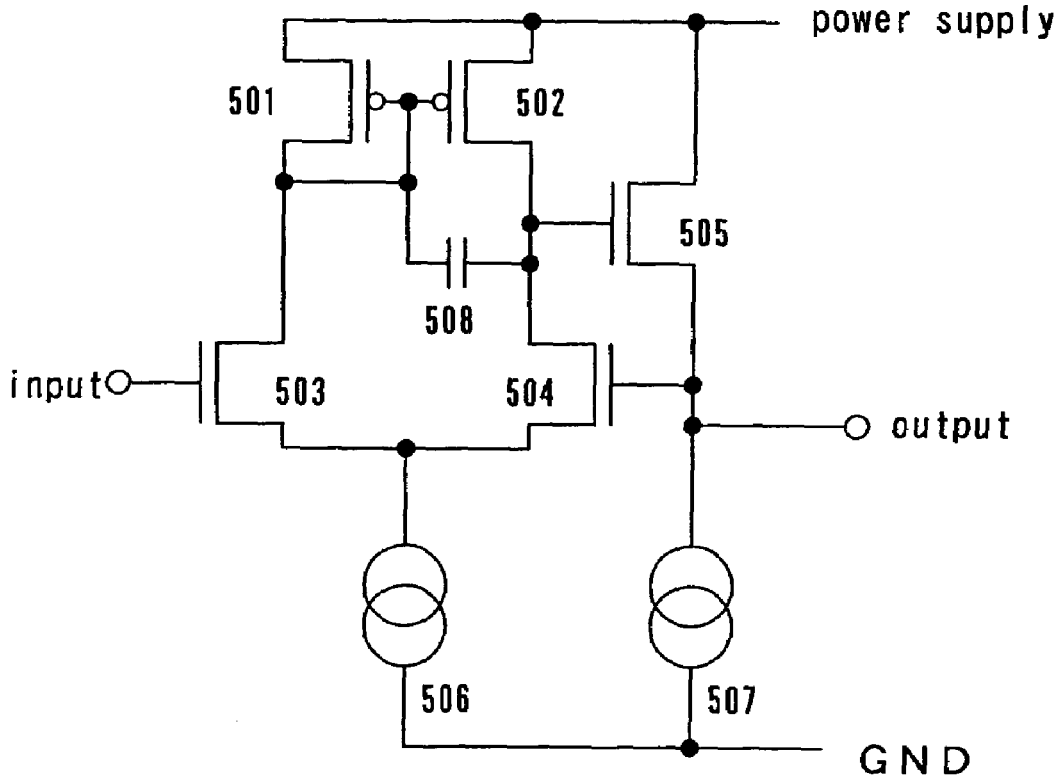
FIG. 5 is a circuit diagram of an operation amplifier type analog buffer.

FIG. 5 shows an operation amplifier circuit as an example of an analog buffer circuit. The output voltage fluctuation of this type of analog buffer circuit depends on fluctuation in characteristic between TFTs 503 and 504, which constitute a differential circuit, and fluctuation between TFTs 501 and 502, which constitute a current mirror circuit. If fluctuation between adjacent TFTs in a pair is small, the overall fluctuation of the panel can be large without causing a problem. For that reason, operation amplifier type analog buffer circuits are often used in integrated circuits.

In this example, the differential circuit is composed of n-channel TFTs and the current mirror circuit is composed of p-channel TFTs. However, the present invention is not limited thereto and the polarities of these circuits may be reversed. Also, the present invention is not limited to the circuit connection shown in this example and any circuit connection can be employed as long as it provides the function of an operation amplifier.

Embodiment 3

Figure 6:
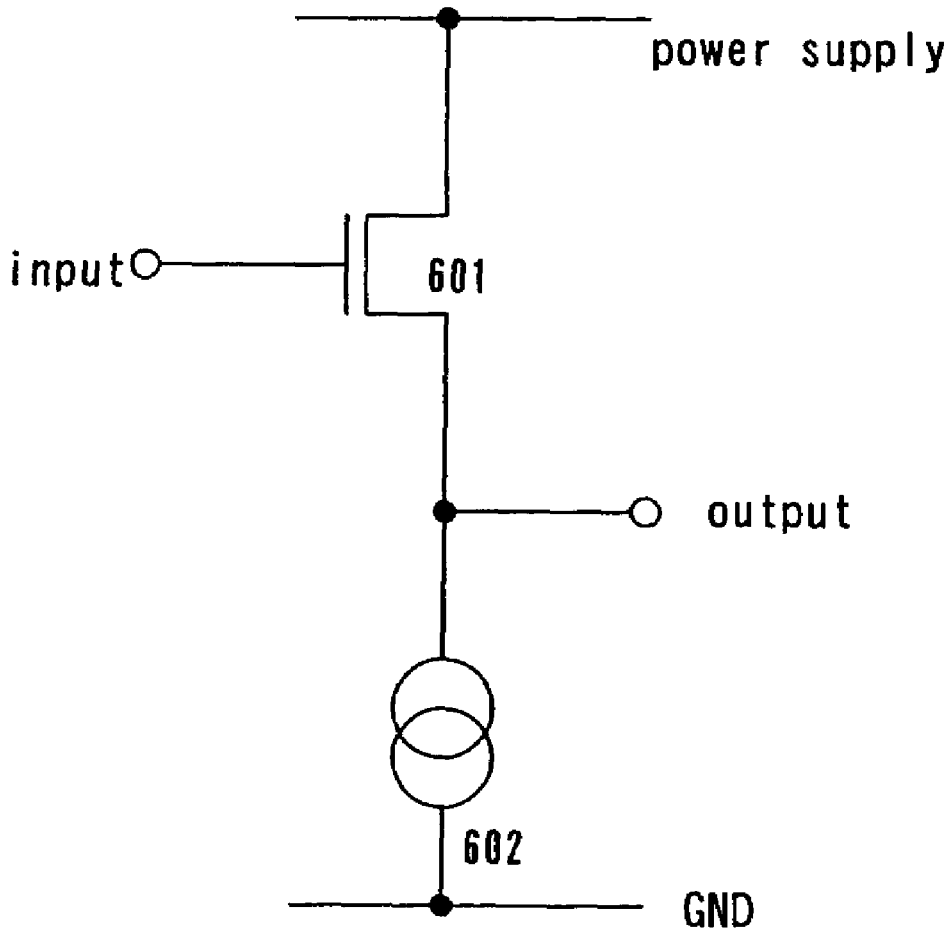
FIG. 6 is a circuit diagram of a source follower type analog buffer.

FIG. 6 shows a source follower circuit as an example of an analog buffer circuit. The source follower circuit is composed of a buffer TFT 601 and a constant current source 602. In this example, the buffer TFT is an n-channel TFT but may be a p-channel TFT instead. When an n-channel TFT is used, the output electric potential of the source follower circuit is lower than the input electric potential by Vgs of the TFT. On the other hand, when a p-channel TFT is used, the output electric potential of the source follower circuit is higher than the input electric potential by Vgs of the TFT. Although the source follower circuit has this problem, it also has an advantage of having a simpler structure than CMOS. In the case where a unipolar process is employed in order to reduce the number of steps in manufacturing a TFT, it is difficult to build an operation amplifier type analog buffer circuit and therefore a source follower type is chosen.

Embodiment 4

Figure 11:
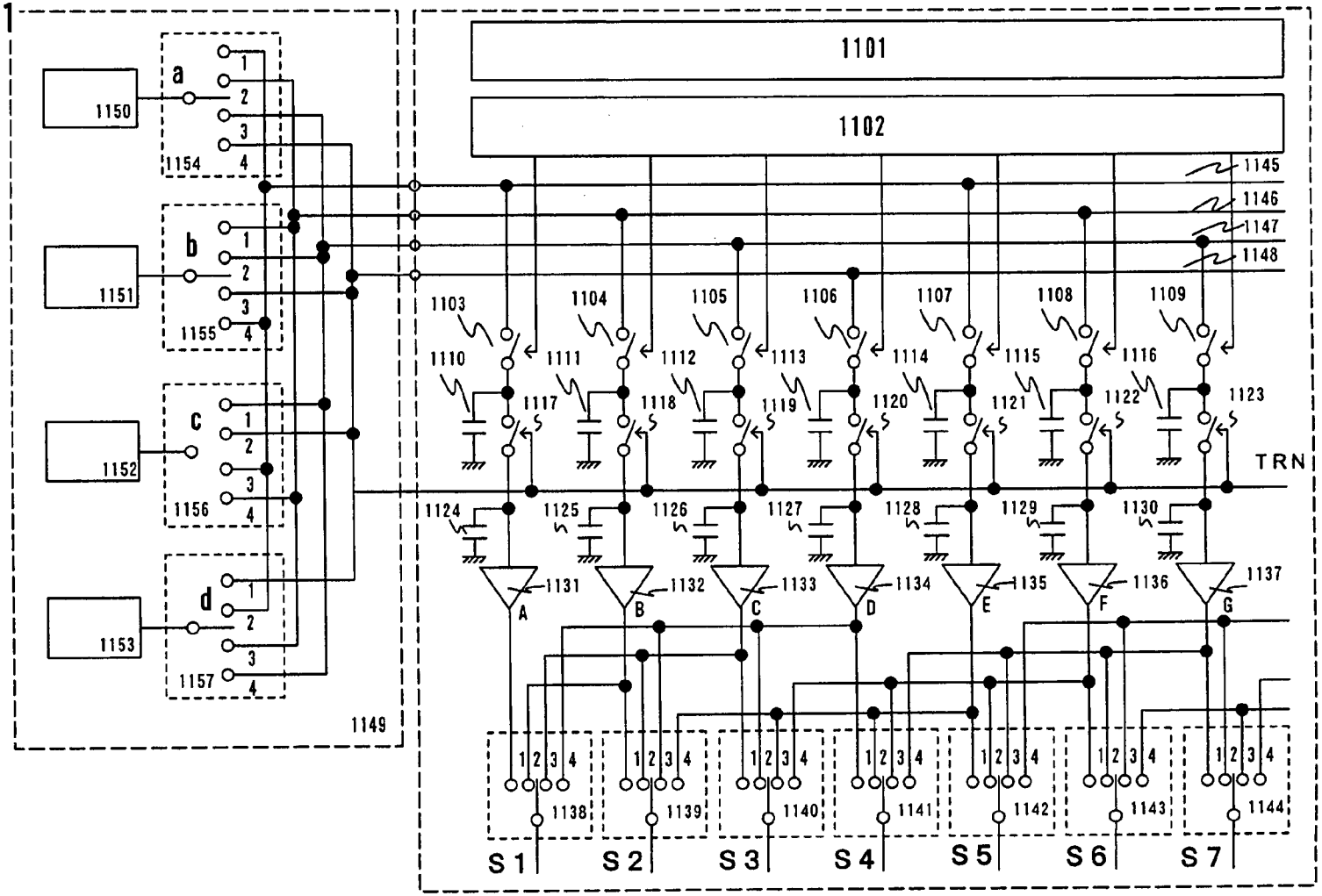
FIG. 11 is a diagram showing video signal switching in the liquid crystal display device of the present invention.

FIG. 11 shows an example in which a circuit for switching video signals to be inputted to a source signal line driving circuit is placed outside of the source signal line driving circuit in order to use a circuit of the present invention. When switching of source signal lines is made in accordance with the present invention solely between analog switches and source signal lines, output fluctuation is reduced but analog buffer output is sent to four source signal lines making it impossible to obtain a normal image. Therefore, signals are switched before inputted to the analog buffer circuits and again switched by switches that are placed downstream of the analog buffer circuits. In this way, a normal image is formed.

As in Embodiment Mode of the present invention, consider a case where switching is made each time a new frame is started. In the first frame, an output of a video circuit 1150 is connected to a video signal line 1145 by connecting a switch 1154 to "1". A signal of the video signal line 1145 is inputted to an analog buffer circuit 1131 through switches 1103 and 1117. A switch 1138 is connected to "1" in the first frame and therefore an output of the analog buffer circuit 1131 is connected to a source signal line S1. Similarly, outputs of video circuits 1151, 1152, and 1153 are connected to source signal lines S2, S3, and S4, respectively.

In the second frame, an output of a video circuit 1150 is connected to a video signal line 1146 by connecting a switch 1154 to "2". A signal of the video signal line 1146 is inputted to an analog buffer circuit 1132 through switches 1104 and 1118. A switch 1138 is connected to "2" in the second frame and therefore an output of the analog buffer circuit 1132 is connected to a source signal line S1. Similarly, outputs of video circuits 1151, 1152, and 1153 are connected to source signal lines S2, S3, and S4, respectively.

In the third frame, an output of a video circuit 1150 is connected to a video signal line 1147 by connecting a switch 1154 to "3". A signal of the video signal line 1147 is inputted to an analog buffer circuit 1133 through switches 1105 and 1119. A switch 1138 is connected to "3" in the third frame and therefore an output of the analog buffer circuit 1133 is connected to a source signal line S1. Similarly, outputs of video circuits 1151, 1152, and 1153 are connected to source signal lines S2, S3, and S4, respectively.

In the fourth frame, an output of a video circuit 1150 is connected to a video signal line 1148 by connecting a switch 1154 to "4". A signal of the video signal line 1148 is inputted to an analog buffer circuit 1134 through switches 1106 and 1120. A switch 1138 is connected to "4" in the fourth frame and therefore an output of the analog buffer circuit 1134 is connected to a source signal line S1. Similarly, outputs of video circuits 1151, 1152, and 1153 are connected to source signal lines S2, S3, and S4, respectively.

In this way, the output of the video circuit 1150 is connected to the source signal line S1 in each frame. This makes it possible to switch analog buffer circuits from one to another each time a new frame is started while obtaining a normal image. Similarly, in any frame, the outputs of the video circuits 1151, 1152, and 1153 are connected to the source signal lines S2, S3, and S4, respectively.

Such circuit can be obtained by placing a substrate (printed board or flexible substrate) outside of a TFT substrate, or by bonding an LSI chip to the top face of a TFT substrate, or by using TFTs to form the video switching circuit and the pixel portion on the same substrate.

Embodiment 5

Figure 12:
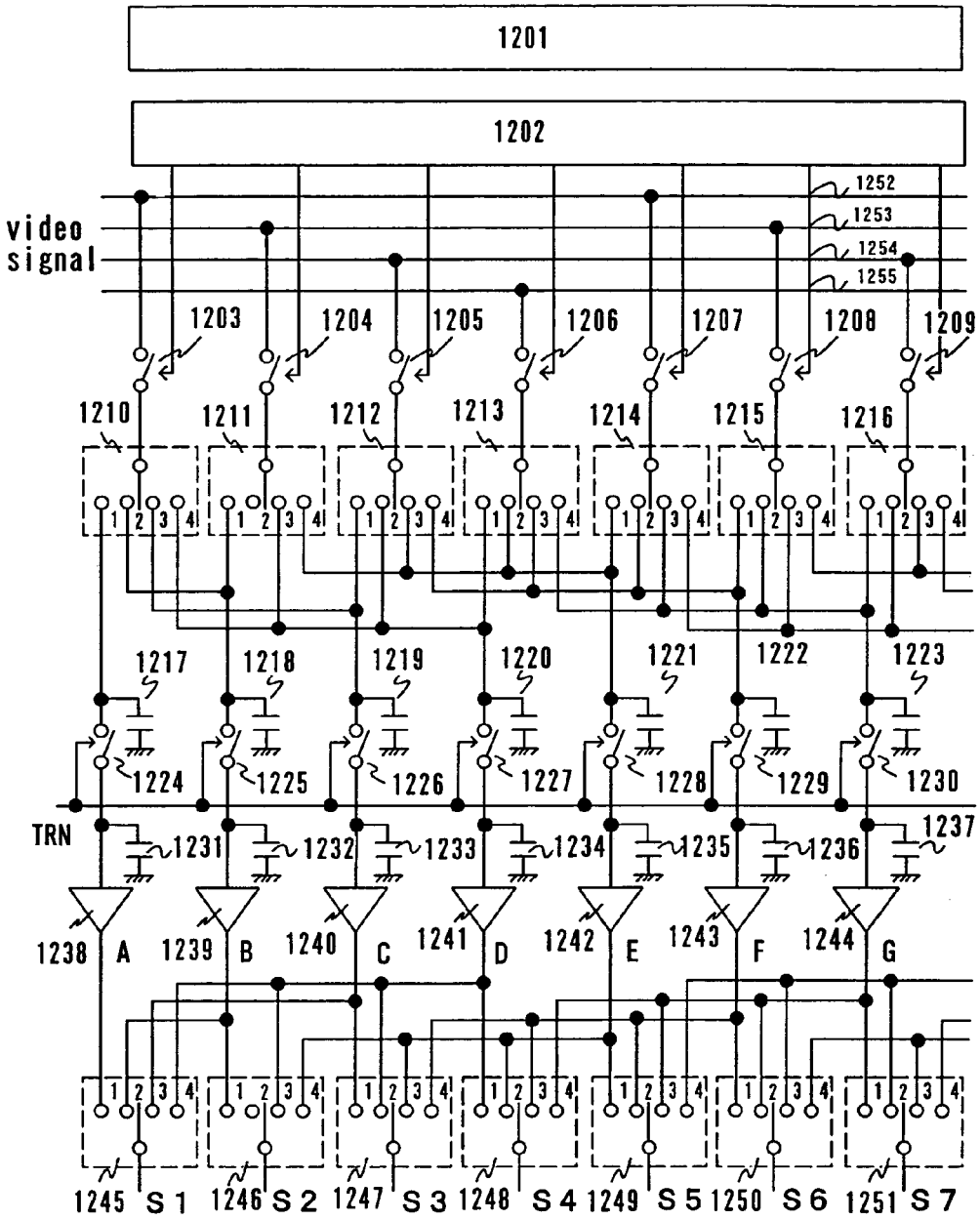
FIG. 12 is a diagram showing the video signal switching in the liquid crystal display device of the present invention.

This embodiment describes an example of incorporating a switching circuit in a source signal line driving circuit. In this embodiment, a switching circuit is placed between analog buffer circuits and video signal lines as shown in FIG. 12.

As in Embodiment Mode of the present invention, consider a case where switching is made each time a new frame is started. In the first frame, an output of a video signal line 1252 passes through a switch 1203 and is connected to an analog memory 1217 and a switch 1224 by connecting a switch 1210 to "1". A signal of the video signal line 1252 is inputted to an analog memory 1231 and an analog buffer circuit 1238 through the switch 1224. A switch 1245 is connected to "1" in the first frame and therefore an output of the analog buffer circuit 1238 is connected to a source signal line S1. Similarly, outputs of video signal lines 1253, 1254, and 1255 are connected to the source signal lines S2, S3, and S4, respectively.

Next, in the second frame, an output of a video signal line 1252 passes through a switch 1203 and is connected to an analog memory 1218 and a switch 1225 by connecting a switch 1210 to "2". A signal of the video signal line 1252 is inputted to an analog memory 1232 and an analog buffer circuit 1239 through the switch 1225. A switch 1245 is connected to "2" in the second frame and therefore an output of the analog buffer circuit 1239 is connected to a source signal line S1. Similarly, outputs of video signal lines 1253, 1254, and 1255 are connected to the source signal lines S2, S3, and S4, respectively.

Then, in the third frame, an output of a video signal line 1252 passes through a switch 1203 and is connected to an analog memory 1219 and a switch 1226 by connecting to a switch 1210 to "3". A signal of the video signal line 1252 is inputted to an analog memory 1233 and an analog buffer circuit 1240 through the switch 1226. A switch 1245 is connected to "3" in the third frame and therefore an output of the analog buffer circuit 1240 is connected to a source signal line S1. Similarly, outputs of video signal lines 1253, 1254, and 1255 are connected to the source signal lines S2, S3, and S4, respectively.

Then, in the fourth frame, an output of a video signal line 1252 passes through a switch 1203 and is connected to an analog memory 1220 and a switch 1227 by connecting to a switch 1210 to "4". A signal of the video signal line 1252 is inputted to an analog memory 1234 and an analog buffer circuit 1241 through the switch 1227. A switch 1245 is connected to "4" in the fourth frame and therefore an output of the analog buffer circuit 1241 is connected to a source signal line S1. Similarly, outputs of video signal lines 1253, 1254, and 1255 are connected to the source signal lines S2, S3, and S4, respectively.

In this way, the output of the video signal line 1252 is connected to the source signal line S1 in each frame. This makes it possible to switch analog buffer circuits from one to another each time a new frame is started while obtaining a normal image. Similarly, in any frame, the outputs of the video signal lines 1253, 1254, and 1255 are connected to the source signal lines S2, S3, and S4, respectively.

Embodiment 6

In Embodiment Mode and Embodiments 1, 4, and 5 of the present invention, the switching is made periodically in predetermined order. However, the switching does not always have to be made in fixed order. For instance, Embodiment Mode, where the source signal line S1 is sequentially connected to the analog buffer outputs A, B, C, and D in the first four frames and to A, B, C, and D in the next four frames to repeat it periodically, may be modified such that S1 is sequentially connected to A, B, C, and D in the first four frames and to C, B, D, and A in the next four frames, thereby setting up random order. In this case, the circuits shown in Embodiments 1 through 5 can be combined with this Embodiment freely.

A display device of the present invention is not limited to the source signal line driving circuit structure of this embodiment and can employ any known source signal line driving circuit structure.

Embodiment 7

Figure 9:
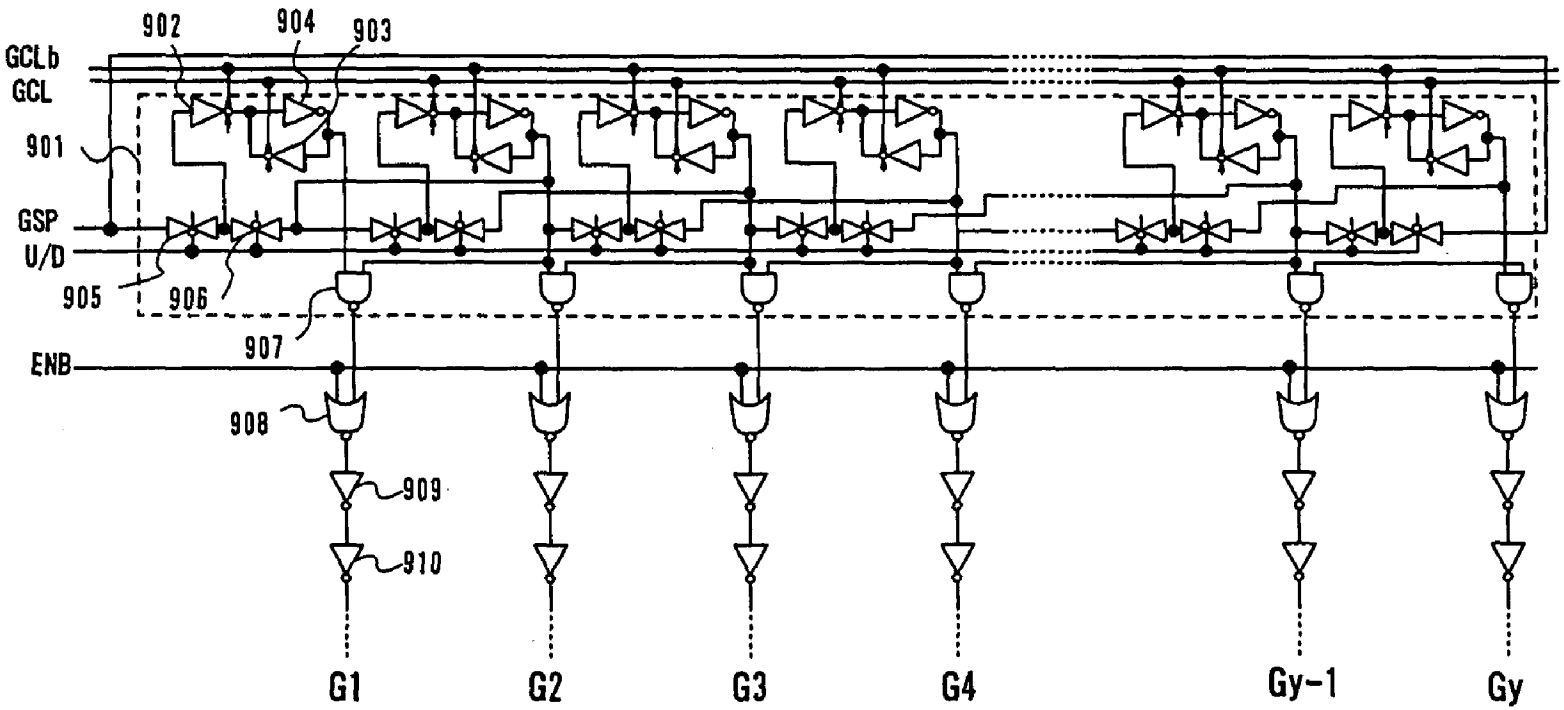
FIG. 9 is a circuit diagram of a gate signal line driving circuit of the present invention.

This embodiment describes with reference to FIG. 9 an example of the structure of a gate signal line driving circuit in a display device of the present invention.

The gate signal line driving circuit is composed of a shift register, a scanning direction switching circuit, and other components. Though not shown in the drawing, a level shifter, a buffer, and the like may be added as needed.

The shift register receives a start pulse GSP, a clock pulse GCL, and others and outputs a gate signal line selecting signal.

The shift register, which is denoted by 901, is composed of clocked inverters 902 and 903, an inverter 904, and a NAND 907. A start pulse GSP is inputted to the shift register 901, and a clock pulse GCL and an inverted clock pulse GCLb, which is obtained by inverting the polarity of GCL, turn the clocked inverters 902 and 903 conductive and unconductive. Sampling pulses are thus outputted from the NAND 907 sequentially.

The scanning direction switching circuit is composed of switches 905 and 906, and switches the operation direction of the shift register to left and right in the drawing. When a scanning direction switching signal U/D is a Lo signal, the shift register outputs sampling pulses sequentially from left to right of FIG. 9. On the other hand, when a scanning direction switching signal U/D is a Hi signal, the shift register outputs sampling pulses sequentially from right to left of the drawing.

Sampling pulses outputted from the shift register are inputted to a NOR 908 and put into calculation with enable signals ENB. The purpose of this computing is to avoid an error of selecting adjacent gate signal lines simultaneously which is caused by dulled sampling pulses. Signals outputted from the NOR 908 are outputted to gate signal lines G1 to Gy through buffers 909 and 910.

A start pulse GSP, a clock pulse GCL, and others that the shift register receives are inputted from an external timing controller.

A display device of the present invention is not limited to the gate signal line driving circuit structure of this embodiment and can employ any known gate signal line driving circuit structure freely. This embodiment can be combined with other embodiments of the present invention.

Embodiment 8

Figure 15:
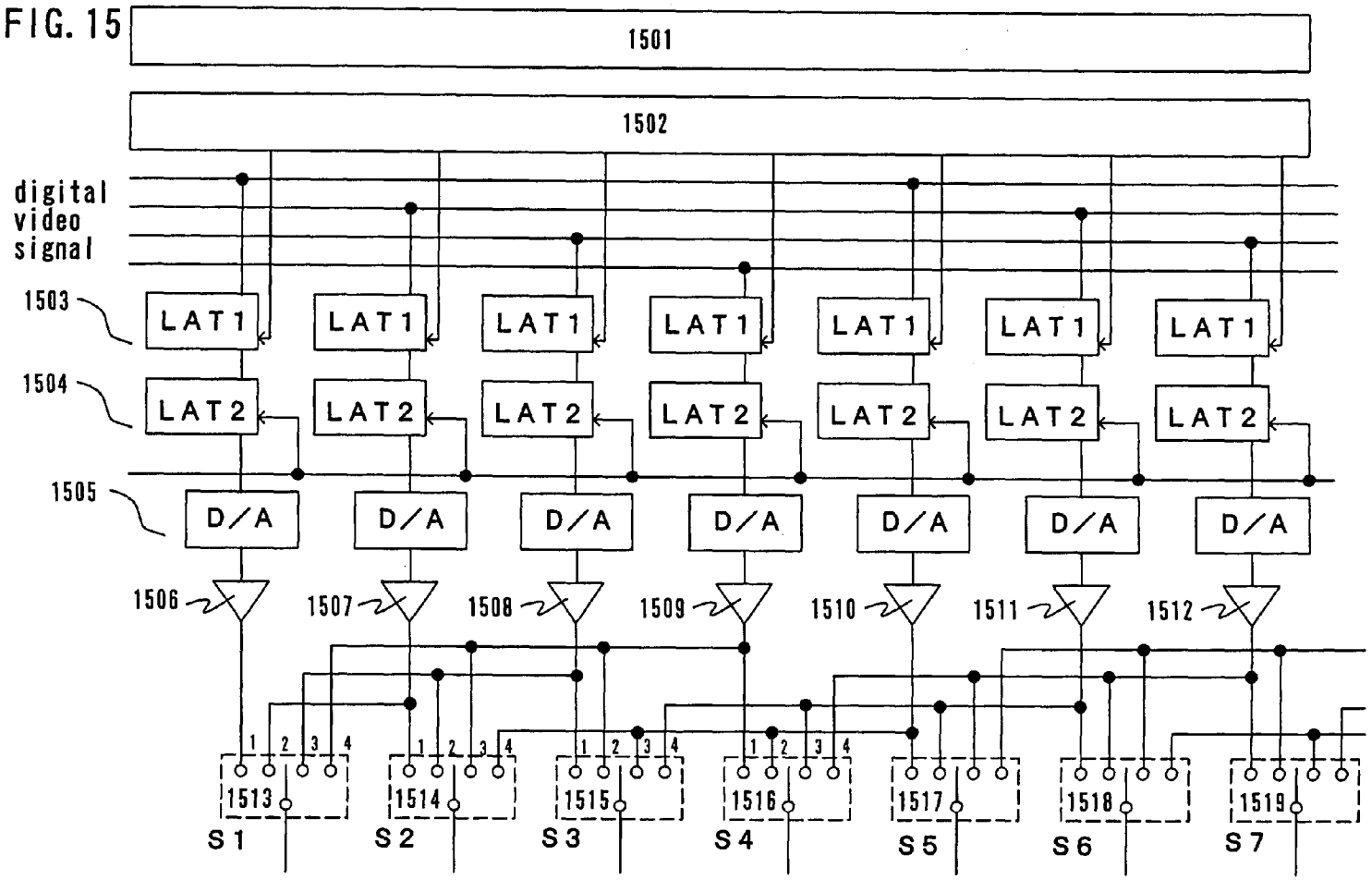
FIG. 15 is a block diagram of a digital source signal line driving circuit to which the present invention is applied.

FIG. 15 shows an example of a digital input source signal line driving circuit. Output of a shift register 1501 is inputted to a latch circuit 1503 through a buffer circuit 1502. The latch circuit has a function of taking in and storing a digital video signal when output of the buffer circuit becomes active. During one line period, the shift register takes in digital video signals as need arises and one line of digital data are stored. After storing one line of data is finished, latch pulses are inputted in the retrace period and the data in the latch circuit 1503 are sent to a latch circuit 1504.

The data in the latch circuit 1504 are held until the next retrace period. While kept in the latch circuit 1504, the data receive analog conversion by a D/A converter 1505. Output of the D/A converter is used to drive source signal lines through an analog buffer circuit 1506 and a switch 1513.

The switch circuit 1513 operates in the same way as the switch does in Embodiment Mode, and connects a source signal line S1 to the analog buffer circuit 1506 in the first frame, to an analog buffer circuit 1507 in the second frame, to an analog buffer circuit 1508 in the third frame, and to an analog buffer circuit 1509 in the fourth frame. In this way, output fluctuation of the analog buffer circuits is averaged as in Embodiment Mode. Display unevenness is thus reduced and the image quality is improved. This embodiment can be combined with other embodiments.

Embodiment 9

Figure 16A:
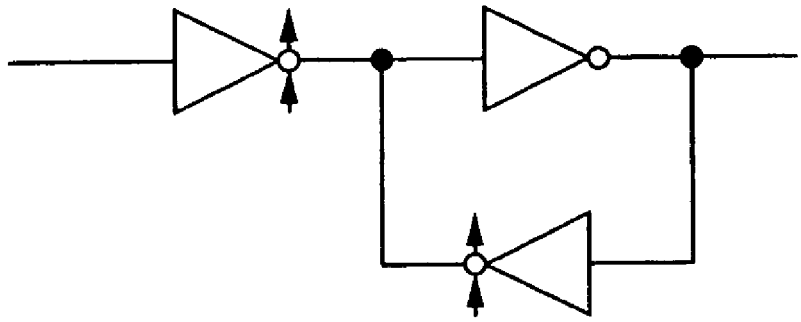
FIGS. 16A to 16C are circuit diagrams of latch circuits in the digital source signal line driving circuit.
Figure 16B:
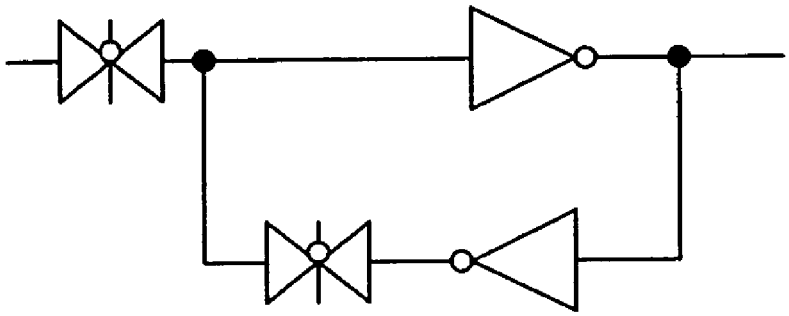
Figure 16C:
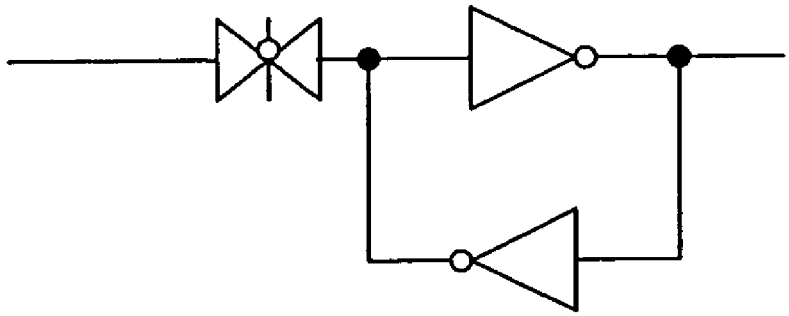

FIGS. 16A to 16C show specific examples of the latch circuits shown in Embodiment 8. The latch circuit in FIG. 16A uses a clocked inverter and is also employed in the shift register of the signal line driving circuit described above. The latch circuit in FIG. 16B is a combination of inverters and analog switches. The latch circuit in FIG. 16C is obtained by removing one analog switch from FIG. 16B. Of the two inverter circuits in FIG. 16C, the one whose output is connected to the analog switch is designed to have a less drive performance than that of the analog switch, so that the memory state can be changed by operating the analog switch. Any of these latch circuits is employable. Further, circuits other than those shown here may be employed. This embodiment can be combined with other embodiments of the present invention.

Embodiment 10

Figure 13:
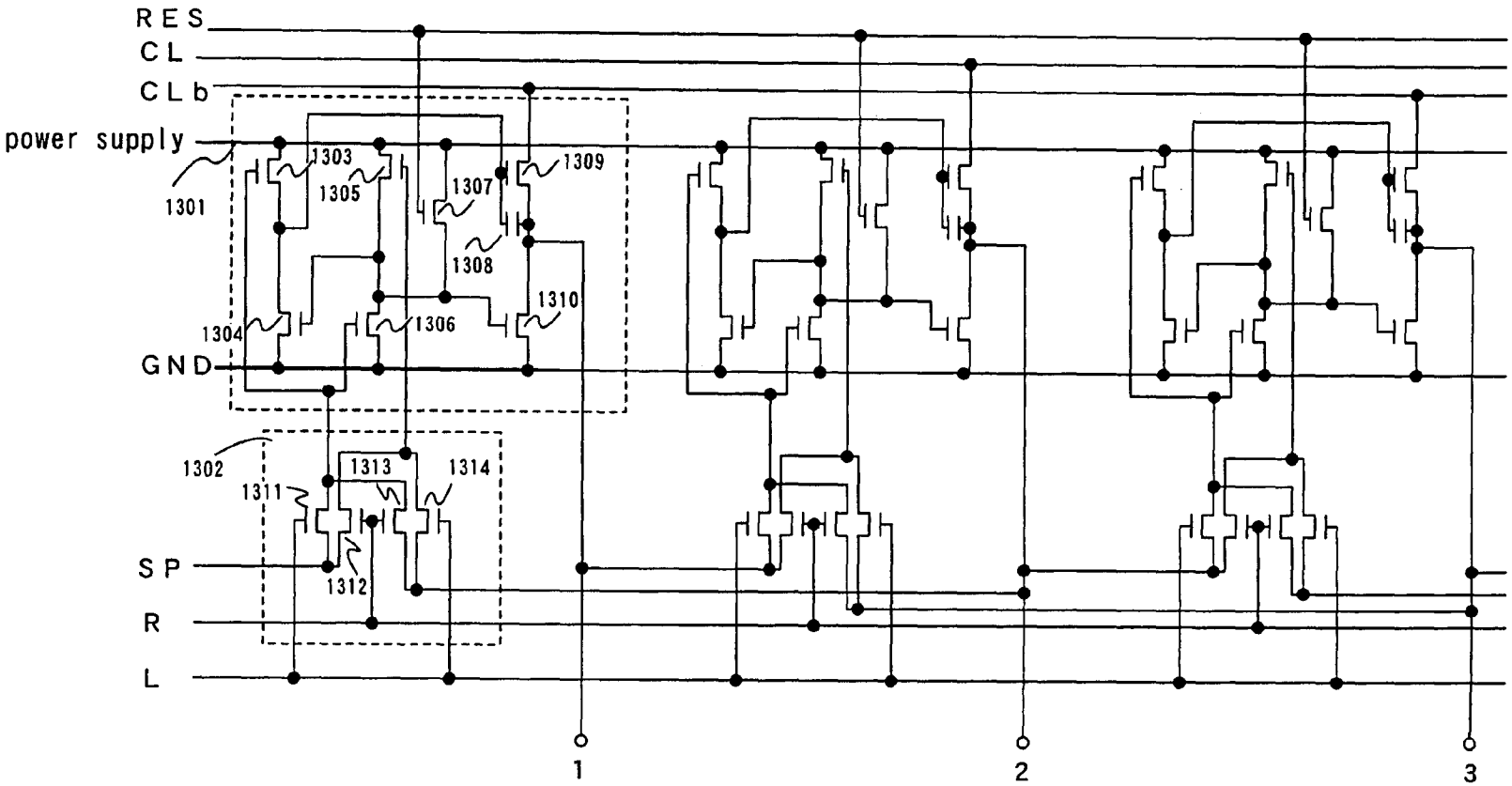
FIG. 13 is a circuit diagram of a shift register that uses unipolar transistors.

FIG. 13 shows an example of using unipolar TFTs to build a shift register. The example shown in FIG. 13 uses n-channel TFTs. Instead, all the TFTs employed may be p-channel TFTs. The use of unipolar process makes it possible to reduce the number of masks.

In FIG. 13, a start pulse is inputted to a scanning direction switching switch 1302, and through a switching TFT 1311, inputted to a shift register 1301. The shift register 1301 is a set reset type shift register which uses boot strap. The operation of the shift register 1301 will be described below.

A start pulse is inputted to a gate of a TFT 1303 and a gate of a TFT 1306. As the TFT 1306 is turned ON, a gate of a TFT 1304 is set to Lo turning the TFT 1304 OFF. A gate of a TFT 1310 is also set to Lo to turn the TFT 1310 OFF. The electric potential of the gate of the TFT 1303 is raised to the level of the power supply electric potential. Therefore, the electric potential of a gate of the TFT 1309 is first raised to the level of power supply electric potential—Vgs. Since the initial electric potential of an output 1 is Lo, the TFT 1309 raises the source electric potential while charging the output 1 and a capacitor 1308. When the gate of the TFT 1309 reaches power supply electric potential—Vgs, the TFT 1309 is still ON to cause the output 1 to continue its rise in electric potential. The gate of the TFT 1309 has no electric discharge path and therefore continues to rise in electric potential along with its source past the power supply electric potential.

As a drain of the TFT 1309 and the source thereof reach the same electric potential, the current flow to the output is stopped to stop the rise in electric potential of the TFT 1309. The output 1 thus can output Hi electric potential equal to the power supply electric potential. At this point, the electric potential of CLb is set to Hi. When CLb is dropped to Lo, electric charges in the capacitor 1308 are sent to Cub through the TFT 1309 to drop the output 1 to Lo. Pulses of the output 1 are transferred to the shift register of the next stage. The above is the operation of the circuit of Embodiment 10. This embodiment can be combined with other embodiments of the present invention.

Embodiment 11

Figure 14:
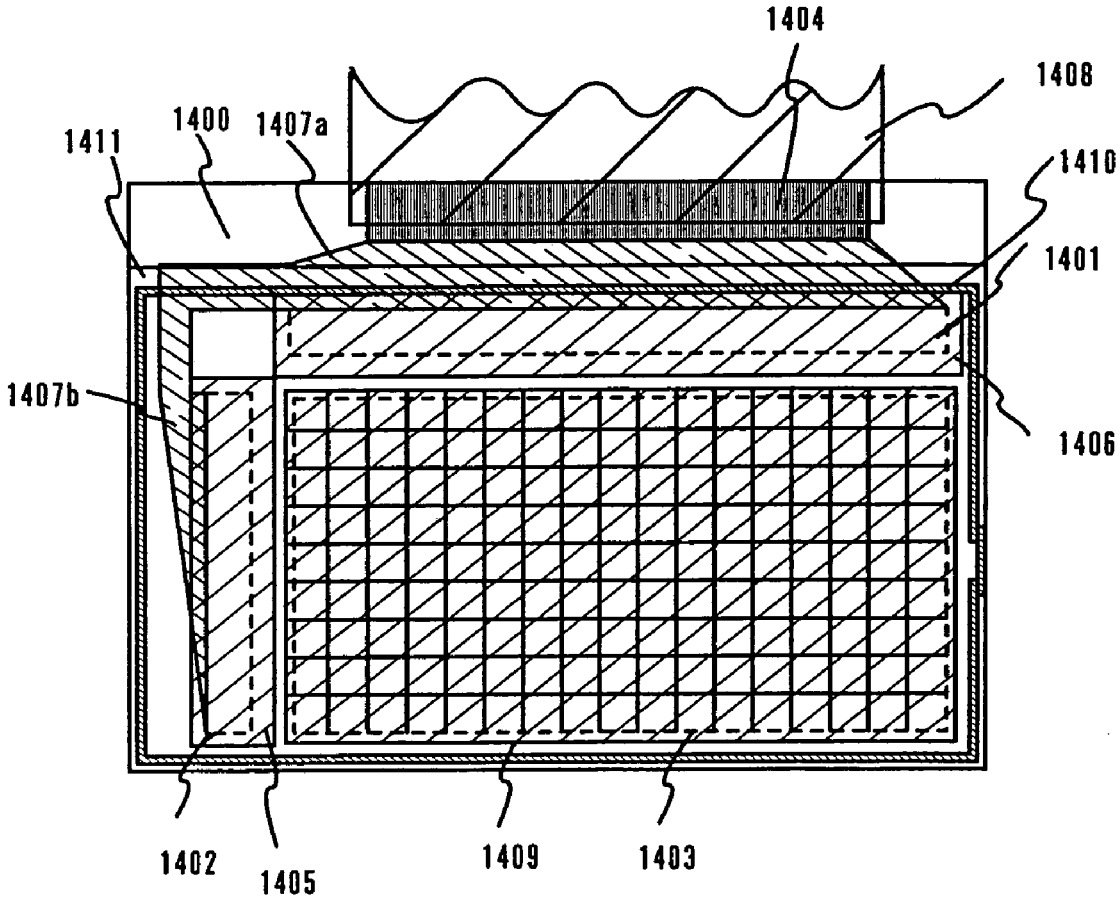
FIG. 14 is an exterior view of the liquid crystal display device of the present invention.

FIG. 14 is a top view of a liquid crystal display device of the present invention. In FIG. 14, an active matrix substrate has a pixel portion 1403, a source signal line driving circuit 1401, a gate signal line driving circuit 1402, an external input terminal 1404 to which an FPC terminal 1408 is bonded, wires 1407*a* and 1407*b* for connecting the external input terminal to an input portion of each circuit, etc. The active matrix substrate is bonded to an opposite substrate 1411, which has a color filter and other components, with a seal member 1410 interposed between the two substrates.

A light-shielding layer 1405 is provided on the opposite substrate side so as to overlap the source signal line driving circuit 1401. A light-shielding layer 1406 is formed on the opposite substrate side so as to overlap the gate signal line driving circuit 1402. A color filter 1409 is provided on the opposite substrate side above the pixel portion 1403, and is composed of a light-shielding layer and colored layers of three colors, red (R), green (G), and blue (B) to suite the colors of the pixels. In actual display, a red (R) colored layer, a green (G) colored layer, and a blue (B) colored layer form a full color image. The colored layers of the three colors are arranged arbitrarily.

Although the color filter 1409 is placed on the opposite substrate here in order to obtain a color image, there is no particular limitation. The color filter may be formed on the active matrix substrate during manufacture of the active matrix substrate.

In the color filter, a light-shielding layer is provided between adjacent pixels in order to shield portions other than the display region against light. The light-shielding layers 1405 and 1406 in the regions that cover the driving circuits may be omitted since the regions covering the driving circuits are covered when the liquid crystal display device is installed as a display unit in electronic equipment. Alternatively, the active matrix substrate may be provided with a light-shielding layer during manufacture of the active matrix substrate.

It is also possible to shield the portions other than the display region (gaps between pixel electrodes) and the driving circuits against light without using the above light-shielding layers. In this case, the plural colored layers that constitute the color filter are stacked and suitably arranged between the opposite substrate and the opposite electrode so as to shield those regions against light.

The liquid crystal display device is thus completed. This embodiment shows a method of manufacturing an active matrix liquid crystal display device of transmissive type but an active matrix liquid crystal display device of reflective type can be manufactured by a similar method. This embodiment can be combined with other embodiments of the present invention.

Embodiment 12

A liquid crystal display device manufactured as above can constitute a liquid crystal module and can be used as a display unit of various electronic equipment. Given below is a description on electronic equipment in which a liquid crystal display device manufactured in accordance with the present invention is incorporated as a display medium.

As examples of such electronic equipment, video cameras, digital cameras, goggle type displays (head mounted displays), navigation systems, audio playback devices (car audios, audio components, etc.), notebook type personal computers, game machines, portable information terminals (mobile computers, mobile telephones, mobile type game machines, and electronic books, etc.), image reproduction devices equipped with a recording medium (specifically, devices equipped with a display device capable of reproducing the recording medium such as a digital versatile disk (DVD), etc. and displaying the image thereof), and the like can be given. An example of these electronic equipment is shown in FIG. 17.

Figure 17A:
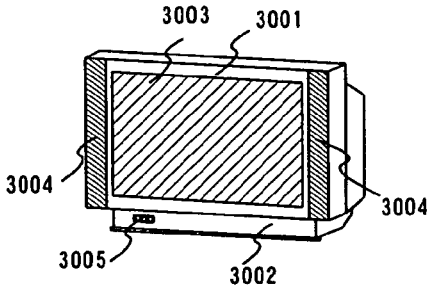
FIGS. 17A to 17H are diagrams of electronic equipment using the liquid crystal display device of the present invention.

FIG. 17A is a display device, which is composed of a frame 2001, a support base 2002, a display portion 2003, a speaker portion 2004, a video input terminal 2005, and the like. The light emitting device manufactured according to the present invention is used for the display portion 2003 to manufacture the display device. As the light emitting device having a light emitting element is a self-luminous type, there is no need for a backlight, whereby it is possible to obtain a thinner display portion than that of a liquid crystal display device. Note that the term display device includes all display devices for displaying information, such as those for personal computers, those for receiving TV broadcasting, and those for advertising.

Figure 17B:
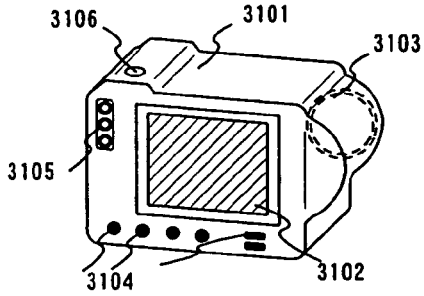

FIG. 17B is a digital still camera, which is composed of a main body 2101, a display portion 2102, an image-receiving portion 2103, operation keys 2104, an external connection port 2105, a shutter 2106, and the like. The light emitting device manufactured according to the present invention is used for the display portion 2102 to manufacture the digital still camera.

Figure 17C:
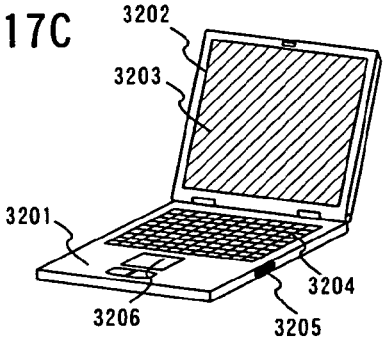

FIG. 17C is a notebook type personal computer, which is composed of a main body 2201, a frame 2202, a display portion 2203, a keyboard 2204, an external connection port 2205, a pointing mouse 2206, and the like. The light emitting device manufactured according to the present invention is used for the display portion 2203 to manufacture the notebook type personal computer.

Figure 17D:
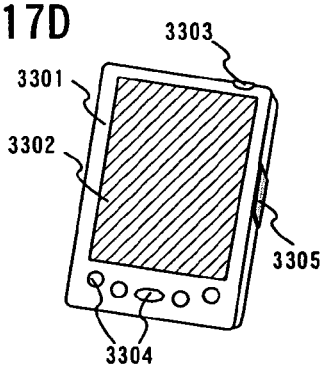

FIG. 17D is a mobile computer, which is composed of a main body 2301, a display portion 2302, a switch 2303, operation keys 2304, an infrared port 2305, and the like. The light emitting device manufactured by the present invention is used for the display portion 2302 to manufacture the mobile computer.

Figure 17E:
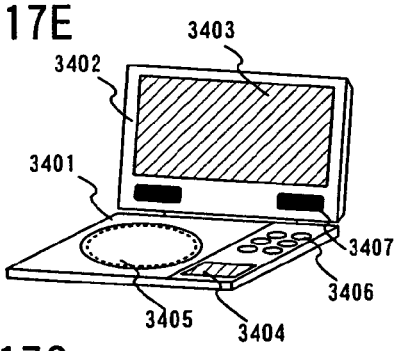

FIG. 17E is a portable image reproduction device provided with a recording medium (specifically, a DVD playback device), which is composed of a main body 2401, a frame 2402, a display portion A 2403, a display portion B 2404, a recording medium (such as a DVD) read-in portion 2405, operation keys 2406, a speaker portion 2407, and the like. The display portion A 2403 mainly displays image information, and the display portion B 2404 mainly displays character information, and the light emitting device manufactured according to the present invention can be used in the display portion A 2403 and in the display portion B 2404 to manufacture the portable image reproduction device. Note that image reproduction devices provided with a recording medium include game machines for domestic use and the like.

Figure 17F:
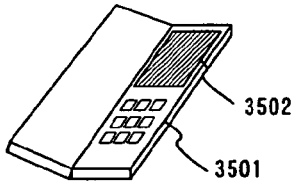

FIG. 17F is a goggle type display (head mounted display) which is composed of a main body 2501, a display portion 2502, an arm 2503, and the like. The light emitting device manufactured according to the present invention can be used in the display portion 2502 to manufacture the goggle type display.

Figure 17G:
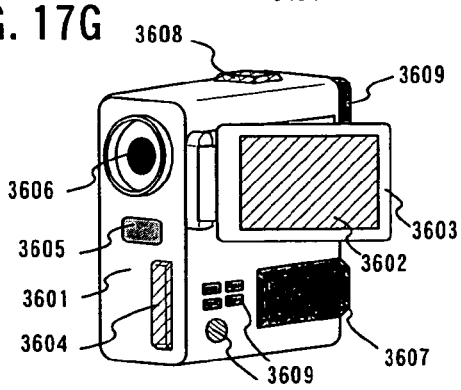

FIG. 17G is a video camera, which is composed of a main body 2601, a display portion 2602, a frame 2603, an external connection port 2604, a remote control receiving portion 2605, an image receiving portion 2606, a battery 2607, an audio input portion 2608, operation keys 2609, an eyepiece portion 2610, and the like. The light emitting device manufactured according to the present invention is used for the display portion 2602 to manufacture the video camera.

Figure 17H:
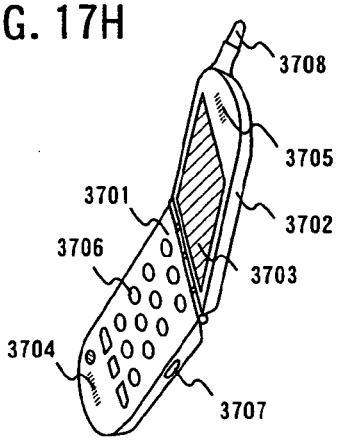

FIG. 17H is a mobile telephone, which is composed of a main body 2701, a frame 2702, a display portion 2703, an audio input portion 2704, an audio output portion 2705, operation keys 2706, an external connection port 2707, an antenna 2708, and the like. The light emitting device manufactured according to the present invention is used for the display portion 2703 to manufacture the mobile telephone. Note that by displaying white characters on a black background, the display portion 2703 can suppress the power consumption of the mobile telephone.

As described above, the application scope of the light emitting device manufactured in accordance with a manufacturing method of the present invention is so wide that the light emitting device of the present invention can be used in electronic equipment of any field. Further, the electronic equipment of this embodiment can be achieved with any construction made by combining Embodiments 1 to 4.

Conventional liquid crystal display devices that use analog buffer circuits for outputs have a problem of vertical streaks which are caused by fluctuation among the analog buffer circuits and which lower the image quality.

According to the present invention, outputs of analog buffer circuits are periodically switched from one to another to average the output voltage fluctuation and the fluctuation in output is thus reduced.

What is claimed is:

1. A liquid crystal display device comprising on an insulating substrate a plurality of source signal lines, a plurality of gate signal lines, a plurality of pixels, and a source signal line driving circuit for driving the source signal lines, wherein the source signal line driving circuit has a plurality of analog buffer circuits, wherein switching circuits are provided between the analog buffer circuits and the source signal lines, wherein a connection between one of the source signal lines and one of the analog buffer circuits is periodically switched to a connection between the one of the source signal lines and another one of the analog buffer circuit by any one of the switching circuits, wherein at least one of the analog buffer circuits is connected to at least first and second contact points of the switching circuits.

wherein a set of n (n is a natural number that satisfies $2 \leqq n$) periods is repeated periodically, and wherein, in an r-th period (r is a natural number that satisfies $1 \leqq r \leqq n$), the switching circuit connects an m-th source signal line (m is a natural number that satisfies $1 \leqq m$) to an (m+r−1)-th analog buffer circuit.

2. A liquid crystal display device comprising on an insulating substrate a plurality of source signal lines, a plurality of gate signal lines, a plurality of pixels, and a source signal line driving circuit for driving the source signal lines, wherein source signal line driving circuit has a plurality of analog buffer circuits, wherein switching circuits are provided between the analog buffer circuits and the source signal lines, wherein a connection between one of the source signal lines and one of the analog buffer circuits is switched to a connection between the one of the source signal lines and another one of the analog buffer circuits in a random timing by any one of the switching circuits, wherein at least one of the analog buffer circuits, is connected to at least first and second contact points of the switching circuits, wherein a set of n (n is a natural number that satisfies $2 \leqq n$) periods is repeated in a random timing, and wherein, in an r-th period (r is a natural number that satisfies $1 \leqq r \leqq n$), the switching circuit connects an m-th source signal line (m is a natural number that satisfies $1 \leqq m$) to an (m+r−1)-th analog buffer circuit.

3. A liquid crystal display device comprising on an insulating substrate a plurality of pixels, a plurality of source signal lines, a plurality of gate signal lines, and a source signal line driving circuit, the source signal line driving circuit having analog buffer circuits to drive the source signal lines, wherein switching circuits are provided between the analog buffer circuits and the source signal lines, wherein a set of n (n is a natural number that satisfies $2 \leqq n$) periods is repeated periodically, and wherein, in an r-th period (r is a natural number that satisfies $1 \leqq r \leqq n$), the switching circuit connects an m-th source signal line (m is a natural number that satisfies $1 \leqq m$) to an (m+r−1)-th analog buffer circuit.

4. A liquid crystal display device comprising on an insulating substrate a plurality of pixels, a plurality of source signal lines, a plurality of gate signal lines, and a source signal line driving circuit, the source signal line driving circuit having analog buffer circuits to drive the source signal lines, wherein switching circuits are provided between the analog buffer circuits and the source signal lines, wherein a set of n (n is a natural number that satisfies $2 \leqq n$) periods is repeated in a random timing, and wherein, in an r-th period (r is a natural number that satisfies $1 \leqq r \leqq n$), the switching circuit connects an m-th source signal line (m is a natural number that satisfies $1 \leqq m$) to an (m+r−1)-th analog buffer circuit.

5. A liquid crystal display device comprising on an insulting substrate a plurality of source signal lines, a plurality of gate signal lines, a plurality of pixels, and a source signal line driving circuit for driving the source signal lines, wherein the source signal line driving circuit has a plurality of analog buffer circuits and switching circuits, and wherein the source signal lines are periodically driven by different analog buffer circuits, wherein a set of n (n is a natural number that satisfies $2 \leqq n$) periods is repeated periodically, and wherein, in an r-th period (r is a natural number that satisfies $1 \leqq r \leqq n$) an m-th source signal line (m is a natural number that satisfies $1 \leqq m$) is driven by an (m+r−1)-th analog buffer circuit.

6. A liquid crystal display device comprising on an insulating substrate a plurality of source signal lines, a plurality of gate signal lines, a plurality of pixels, and a source signal line driving circuit for driving the source signal lines, wherein the source signal line driving circuit has a plurality of analog buffer circuits and switching circuits, wherein the source signal lines are driven by different analog buffer circuits in a random timing, wherein a set of n (n is a natural number that satisfies $2 \leqq n$) periods is repeated in a random timing, and wherein, in an r-th period (r is a natural number that satisfies $1 \leqq r \leqq n$), an m-th source signal line (m is a natural number that satisfies $1 \leqq m$) is driven by an (m+r−1)-th analog buffer circuit.

7. A liquid crystal display device comprising on an insulating substrate a plurality of pixels, a plurality of source signal lines, a plurality of gate signal lines, and a source signal line driving circuit, the source signal line driving circuit having analog buffer circuits to drive the source signal lines, wherein a set of n (n is a natural number that satisfies $2 \leqq n$) periods is repeated periodically, and wherein, in an r-th period (r is a natural number that satisfies $1 \leqq r \leqq n$), an m-th source signal line (m is a natural number that satisfies $1 \leqq m$) is driven by an (m+r−1)-th analog buffer circuit.

8. A liquid crystal display device comprising on an insulating substrate a plurality of pixels, a plurality of source signal lines, a plurality of gate signal lines, and a source signal line driving circuit, the source signal line driving circuit having analog buffer circuits to drive the source signal lines, wherein a set of n (n is a natural number that satisfies $2 \leqq n$) periods is repeated in a random timing, and wherein, in an r-th period (r is a natural number that satisfies $1 \leqq r \leqq n$), an m-th source signal line (m is a natural number that satisfies $1 \leqq m$) is driven by an (m+r−1)-th analog buffer circuit.

9. A liquid crystal display device according to claim 1, wherein the analog buffer circuits comprise source follower circuits.

10. A liquid crystal display device according to claim 1, wherein the analog buffer circuits comprise voltage follower circuits.

11. A liquid crystal display device according to claim 1, wherein the switching circuits comprise analog switching circuits.

12. An electronic equipment comprising a liquid crystal display device of claim 1.

13. A liquid crystal display device according to claim 2, wherein the analog buffer circuits comprise source follower circuits.

14. A liquid crystal display device according to claim 2, wherein the analog buffer circuits comprise voltage follower circuits.

15. A liquid crystal display device according to claim 2, wherein the switching circuits comprise analog switching circuits.

16. An electronic equipment comprising a liquid crystal display device of claim 2.

17. A liquid crystal display device according to claim 3, wherein the analog buffer circuits comprise source follower circuits.

18. A liquid crystal display device according to claim 3, wherein the analog buffer circuits comprise voltage follower circuits.

19. A liquid crystal display device according to claim 3, wherein the switching circuits comprise analog switching circuits.

20. An electronic equipment comprising a liquid crystal display device of claim 3.

21. A liquid crystal display device according to claim 4, wherein the analog buffer circuits comprise source follower circuits.

22. A liquid crystal display device according to claim 4, wherein the analog buffer circuits comprise voltage follower circuits.

23. A liquid crystal display device according to claim 4, wherein the switching circuits comprise analog switching circuits.

24. An electronic equipment comprising a liquid crystal display device of claim 4.

25. A liquid crystal display device according to claim 5, wherein the analog buffer circuits comprise source follower circuits.

26. A liquid crystal display device according to claim 5, wherein the analog buffer circuits comprise voltage follower circuits.

27. A liquid crystal display device according to claim 6, wherein the analog circuits comprise source follower circuits.

28. A liquid crystal display device according to claim 6, wherein the analog buffer circuits comprise voltage follower circuits.

29. A liquid crystal display device according to claim 7, wherein the analog buffer circuits comprise source follower circuits.

30. A liquid crystal display device according to claim 7, wherein the analog buffer circuits comprise voltage follower circuits.

31. A liquid crystal display device according to claim 8, wherein the analog buffer circuits comprise source follower circuits.

32. A liquid crystal display device according to claim 8, wherein the analog buffer circuits comprise voltage follower circuits.

33. A liquid crystal display device according to claim 5, wherein the switching circuits are provided between the analog buffer circuits and the source signal lines.

34. A liquid crystal display device according to claim 6, wherein the switching circuits are provided between the analog buffer circuits and the source signal lines.

35. A liquid crystal display device according to claim 1, wherein a first switching circuit in the switching circuits includes the first contact point which is connected to the one of the analog buffer circuits and a second switching circuit in the switching circuits includes the second contact point which is connected to the one of the analog buffer circuits.

36. A liquid crystal display device according to claim 2, wherein a first switching circuit in the switching circuits includes the first contact point which is connected to the one of the analog buffer circuits and a second switching circuit in the switching circuits includes the second contact point which is connected to the one of the analog buffer circuits.

* * * * *

UNITED STATES PATENT AND TRADEMARK OFFICE

CERTIFICATE OF CORRECTION

PATENT NO. : 7,193,593 B2
APPLICATION NO. : 10/651231
DATED : March 20, 2007
INVENTOR(S) : Jun Koyama et al.

It is certified that error appears in the above-identified patent and that said Letters Patent is hereby corrected as shown below:

On the Title page of the patent, item (73) please add Assignee: SHARP KABUSHIKI KAISHA, Osaka (JP).

Signed and Sealed this

Twenty-seventh Day of November, 2007

JON W. DUDAS
*Director of the United States Patent and Trademark Office*